US005553442A

United States Patent [19]

Fadaie

[11] Patent Number: 5,553,442

[45] Date of Patent: Sep. 10, 1996

[54] ROBOTIC SYSTEM FOR MIXING ARTICLES IN CONTAINERS

[75] Inventor: Saadat Fadaie, Antioch, Calif.

[73] Assignee: James River Paper Company, Inc., Richmond, Va.

[21] Appl. No.: 319,160

[22] Filed: Oct. 6, 1994

[51] Int. Cl.[6] ..... B65B 35/36

[52] U.S. Cl. ..... 53/445; 53/446; 53/448; 53/474; 53/155; 53/168; 53/238; 53/247; 53/251; 53/543; 414/404; 414/416

[58] Field of Search ..... 414/403, 404, 414/416, 786; 53/147, 168, 154, 155, 537, 540, 543, 544, 237, 238, 244, 247, 249, 250, 251, 443, 445, 446, 448, 473, 474, 475

[56] References Cited

U.S. PATENT DOCUMENTS

| | | | |
|---|---|---|---|
| 2,081,093 | 5/1937 | Miller | 53/474 |
| 2,630,951 | 3/1953 | Slightam | 53/474 X |
| 3,371,767 | 3/1968 | Rehr et al. | 53/154 |
| 3,397,504 | 8/1968 | Drennan | 53/448 |
| 3,509,688 | 5/1970 | Hartbaner et al. | 53/537 X |
| 3,531,912 | 10/1970 | Griner et al. | 53/238 X |
| 3,637,066 | 1/1972 | Idskov et al. . | |
| 4,044,897 | 8/1977 | Maxted . | |
| 4,678,393 | 7/1987 | Mink . | |
| 4,901,504 | 2/1990 | Tsuji et al. | 53/247 |
| 5,007,521 | 4/1991 | Tanaka . | |
| 5,060,455 | 10/1991 | Schmeisser . | |
| 5,096,355 | 3/1992 | Schroder . | |
| 5,129,206 | 7/1992 | Kidani et al. . | |
| 5,161,665 | 11/1992 | Cragun . | |
| 5,193,685 | 3/1993 | Trevithick . | |
| 5,230,206 | 7/1993 | Christ . | |

FOREIGN PATENT DOCUMENTS

| | | | |
|---|---|---|---|
| 2352098 | 4/1975 | Germany | 53/237 |

*Primary Examiner*—John Sipos
*Assistant Examiner*—Daniel Moon
*Attorney, Agent, or Firm*—Thomas R. Lampe

[57] ABSTRACT

A method and apparatus for changing the mix of articles in a plurality of containers. A first set of containers is conveyed to a mixing station, each container of the first set of containers containing a plurality of articles having physical characteristics differing from the physical characteristics of the plurality of articles in the other containers of the first set of containers. A second set of containers is transported to the mixing station, each of the containers of the second set of containers defining a space for accommodating a layer of articles. At the mixing station, articles are removed from each of the containers of the first set of containers, consolidated, and inserted into the containers of the second set of containers at the mixing station to at least partially form a layer of articles therein comprised of a mix of articles from all the containers of the first set of containers.

12 Claims, 8 Drawing Sheets

ROBOTIC SYSTEM FOR MIXING ARTICLES IN CONTAINERS

TECHNICAL FIELD

This invention relates to a method and apparatus for changing the mix of articles in a plurality of containers. The embodiments of the invention disclosed herein are for the purpose of changing the mix of colors of roll paper products in shipping cartons.

BACKGROUND ART

Economies and efficiencies in operation dictate that paper roll products such as rolls of toilet tissue or toweling be produced in large single-color batches and that the rolls produced be loaded into shipping cartons or containers immediately after production. This results in the containers being filled with rolls of a single color. Hundreds, if not thousands, of containers will be so filled and the end result of such an approach is that the manufacturer has produced large quantities of shipping containers filled with towel or tissue rolls of a single color.

Often, however, the customers buying such products wish to have a variety of colors in a single carton. In order to satisfy this desire, it has been standard practice to assemble together a number of cartons, each of which contains articles of a single color differing from the color of those in the other containers. Employees then manually remove a predetermined number of the rolls in any one carton and replace them with rolls from one or more other cartons so that a desired color mix is obtained.

It will be appreciated that this procedure is inefficient, time-consuming and expensive. Furthermore, employees soon find a repetitive task of this nature to be boring, making an inherently inefficient operation even more so. The likelihood of mistakes being made also increases over time, which means that the color mix of the cartons or containers may not be that actually desired.

A search of the prior art located the following United States patents U.S. Pat. No. 5,007,521, issued Apr. 16, 1991; U.S. Pat. No. 4,678,393, issued Jul. 7, 1987; U.S. Pat. No. 5,230,206, issued Jul. 27, 1993; U.S. Pat. No. 5,161,665, issued Nov. 10, 1992; U.S. Pat. No. 5,129,206, issued Jul. 14, 1992; U.S. Pat. No. 5,193,685, issued Mar. 16, 1993; U.S. Pat. No. 5,096,355, issued Mar. 17, 1992; U.S. Pat. No. 5,060,455, issued Oct. 29, 1992; U.S. Pat. No. 4,044,897, issued Aug. 30, 1977, and U.S. Pat. No. 3,637,066, issued Jan. 25, 1972.

The above-identified patents disclose various article-handling and/or packaging arrangements for a wide variety of products. None of the devices in this prior art, however, concern themselves with, or are appropriate for, the efficient automatic repackaging of articles in containers in order to modify the mix of articles therein so that an accumulation of articles having different predetermined physical characteristics is established in each container of a group thereof.

BACKGROUND ART

The present invention encompasses a method of changing the mix of articles in a plurality of containers. The method includes the step of conveying a first set of containers to a mixing station, at least one container of the first set of containers containing a plurality of articles having physical characteristics differing from the physical characteristics of the plurality of articles in at least one of the other containers of the first set of containers. The plurality of articles in each of the plurality of containers of the first set of containers are disposed in a plurality of rows.

A second set of containers is transported to the mixing station, each of the containers of the second set of containers defining a space for a accommodating a layer of articles.

At the mixing station, the step is carried out of substantially simultaneously removing at least one row of articles from each of the containers of the first set of containers. At the mixing station and after the removal step, the rows of articles removed from the containers of the first set of containers are moved relative to one another to consolidate the rows.

The removed and consolidated rows of articles are then substantially simultaneously inserted into at least one container of the second set of containers at the mixing station to at least partially form a layer of articles therein comprised of a mix of articles from all the containers of the first set of containers.

The containers of the second set of containers transported to the mixing station each have a layer of articles therein when transported to the mixing station. The step of substantially simultaneously inserting the removed and consolidated rows of articles comprises placing the removed and consolidated rows of articles on the layer of articles in at least one container of the second set of containers at the mixing station.

The present invention also encompasses apparatus for changing the mix of articles in a plurality of containers. The apparatus includes a mixing station with a first robot having an end effector or end of arm tooling.

First conveyor means is provided for conveying a first set of containers to the mixing station, at least one container of the first set of containers containing a plurality of articles having physical characteristics differing from the physical characteristics of the plurality of articles in at least one of the other containers of the first set of containers and disposed in a plurality of rows.

The apparatus includes transport means for transporting a second set of containers to the mixing station. The containers of the second set of containers each defines a space for accommodating a layer of articles.

The end effector of the first robot is operable to remove at least one row of articles from each of the containers of the first set of containers, moving the rows of articles removed from the containers of the first set of containers relative to one another to consolidate the rows, and insert the removed and consolidated rows of articles into at least one container of a second set of containers transported to the mixing station by the transport means to at least partially form a layer of articles therein comprised of a mix of articles from all the containers of the first set of containers.

Other features, advantages, and objects of the present invention will become apparent with reference to the following description and accompanying drawings.

PREFERRED MODES FOR CARRYING OUT THE INVENTION

Figure 1:
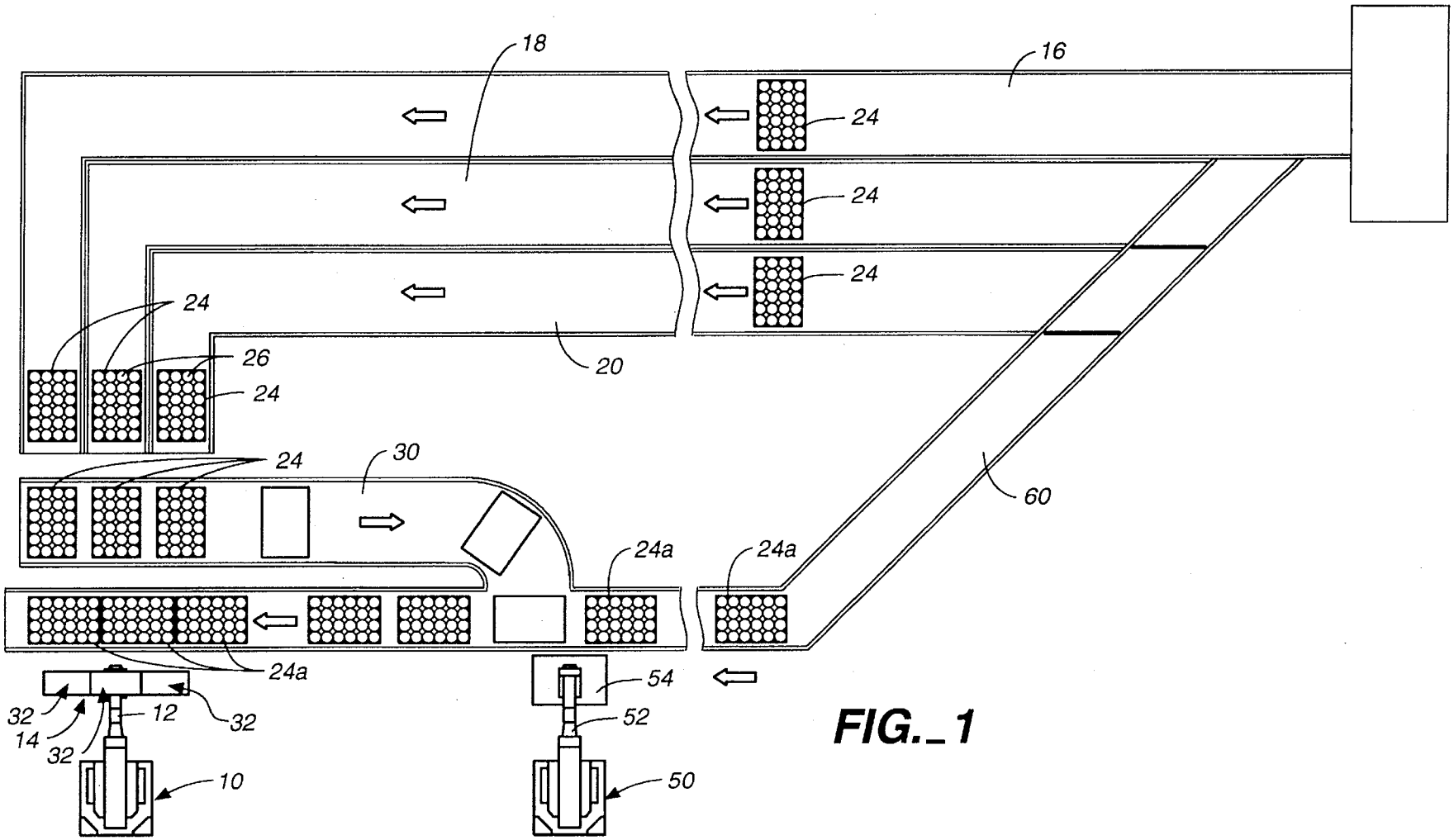
FIG. 1 is a diagrammatic, top plan view of apparatus constructed in accordance with the teachings of the present invention which includes a first robot deployed at a mixing station and a second robot deployed at a robotic work station spaced from the mixing station.

FIG. 1 illustrates somewhat diagrammatically a typical and representative work layout utilized when carrying out the teachings of the present invention. The layout includes a mixing station at which is located a robot 10. Robot 10 includes a robotic arm 12 having an end effector 14 attached to the distal end of the arm 12.

The robot 10 may be of any suitable commercially available type. However, the GMF Model S-700 robot, made available by Fanuc Robotics North America, Inc. of Auburn Hills, Michigan has been found to be particularly suitable for the tasks which will be described below. The GMF Model S-700 robot is a 6-axis articulated arm, electric servo-driven robot, which may be suitably programmed to perform the tasks attributed thereto in the specification.

In the work layout shown in FIG. 1, three conveyors 16, 18, 20 are utilized to convey containers in the form of cartons or boxes 24 as shown by the arrows associated with the conveyors. Conveyor 16 conveys boxes 24 containing packages of rolls 26 which are all of one color, conveyor 18 conveys boxes containing packages of rolls 26 which are all of a second color, and conveyor 20 conveys boxes containing packages of rolls 26 which are all of a third color. The illustrated rolls 26 may, for example, be toilet tissue rolls in three different colors, one color to a container, and overwrapped with plastic or the like to form packages with two or more tiers of rolls. The packages of rolls 26 are, as shown, disposed in rows in the containers. In the arrangement shown, the containers 24 delivered by conveyors 16, 18, 20 have two layers of roll packages therein.

Figures 2A, 2B, 2C:
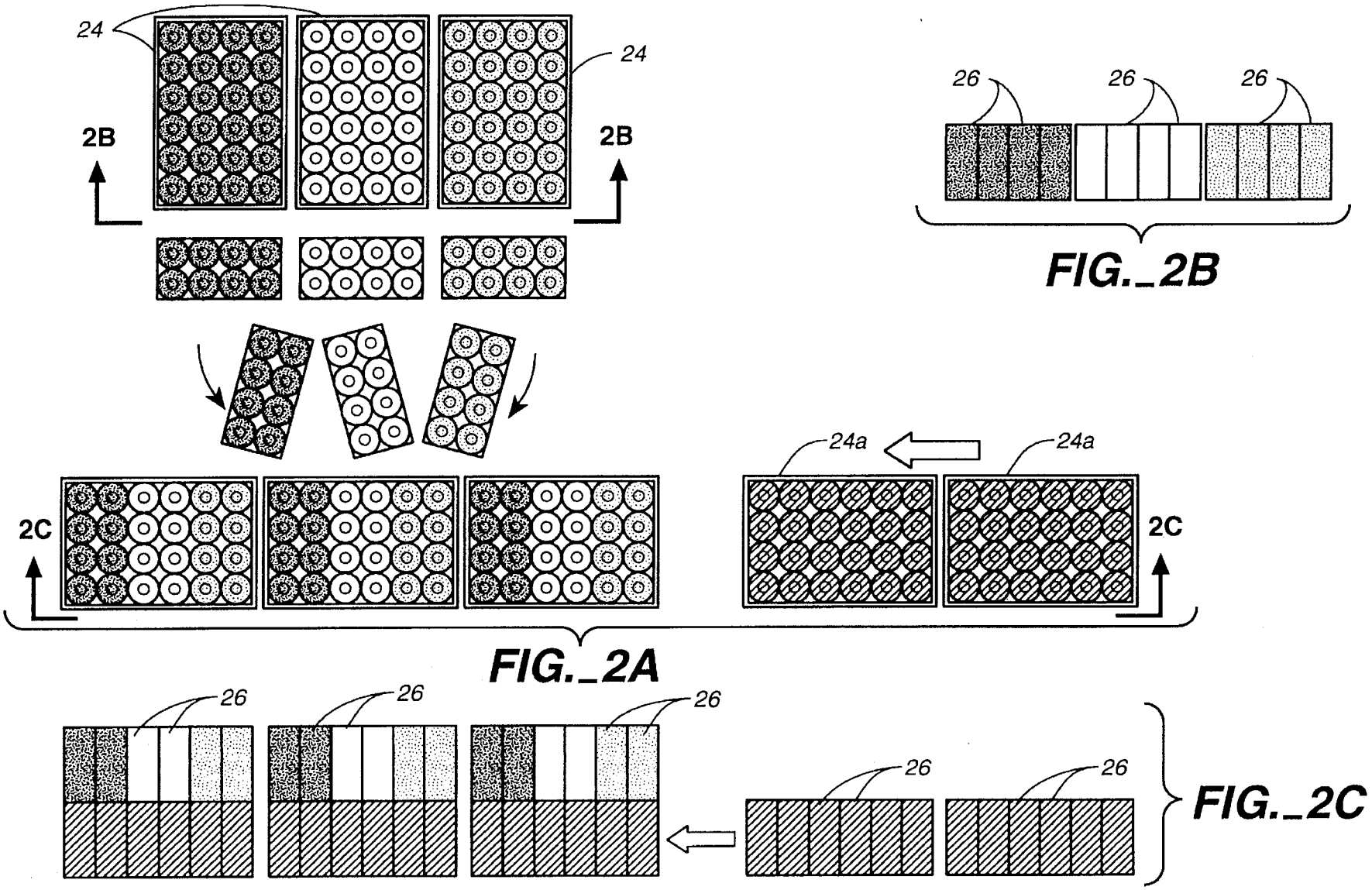
FIG. 2A is a diagrammatic representation illustrating steps carried out at the mixing station during practice of the method of the present invention to mix paper roll products in containers.
FIGS. 2B and 2C are diagrammatic representations of paper rolls as taken along lines 2B—2B and 2C—2C, respectively, in FIG. 2A.

The set of three containers 24 is off-loaded or indexed from conveyors 16, 18, 20 onto a conveyor 30 having an end thereof (the left end as viewed in FIG. 1) at the mixing station serviced by robot 10. When the set of three containers 24 is off-loaded onto conveyor 30, conveyor 30 is not moving. Thus, the containers of the set of three containers positioned on conveyor 30 do not move relative to each other, nor do they move relative to the robot 10. FIG. 2A illustrates at the top thereof three containers 24 of the set of containers as they appear from above when positioned on conveyor 30.

The end effector 14 of robot 10 operates to engage, pick up and remove from each of the three containers 24 positioned on conveyor 30 two rows each of the rolls 26 in the containers 24. That is, the end effector, in the arrangement illustrated, simultaneously picks up three blocks of rolls, each block comprising a third of the rolls in a container layer in two rows of a single roll color.

As will be seen in greater detail below, the end effector 14 comprises three distinct and relatively movable end effector units, each of which is positioned over a block of rolls 26 of a single color. The end effector 14 then is lowered into position on the rolls thereunder and means which will be described below is employed to connect the engaged roll packages to the end effector units. As is also described in detail below, one suitable means for temporarily attaching the packaged rolls to the end effector units is a vacuum-type arrangement which engages the tops of the roll packages. In practice, toilet tissue rolls, paper towels and the like are usually overwrapped with plastic sheet material; thus, a vacuum can readily be formed between the end effector units and the wrapped rolls. In the interest of simplicity, the rolls are illustrated as being elongated and wrapped singly. Of course, the rolls could be wrapped in multi-roll packages with multiple rolls stacked and/or disposed side by side. For example, it is common to package toilet tissue rolls in layers and also in rows. The invention has application to various roll and package configurations.

With particular reference to FIGS. 8–13, each of the three end effector units 32 of end effector 14 includes a plate 34 depending from a rotary actuator 36 depending from a slide arm 38, the slide arm itself being connected directly to the robotic arm by its own rotary actuator 39. In the interest of simplicity, slide arm 38 is only shown in FIGS. 9, 10, 11, and 12. Vacuum cups 40 project from the bottom of each plate 34.

Figure 8:
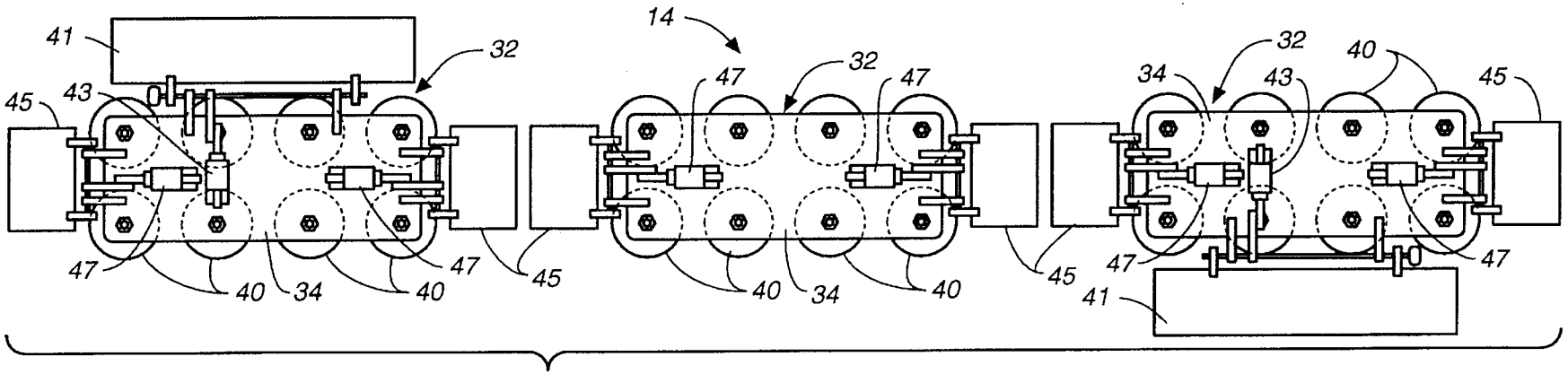
FIG. 8 is a diagrammatic top view of three cooperable end effector units of a different form of end effector employable at the mixing station and incorporating both vacuum cups and clamping elements, said end effector units illustrated in the relative positions assumed thereby at one stage of operation.
Figure 9:
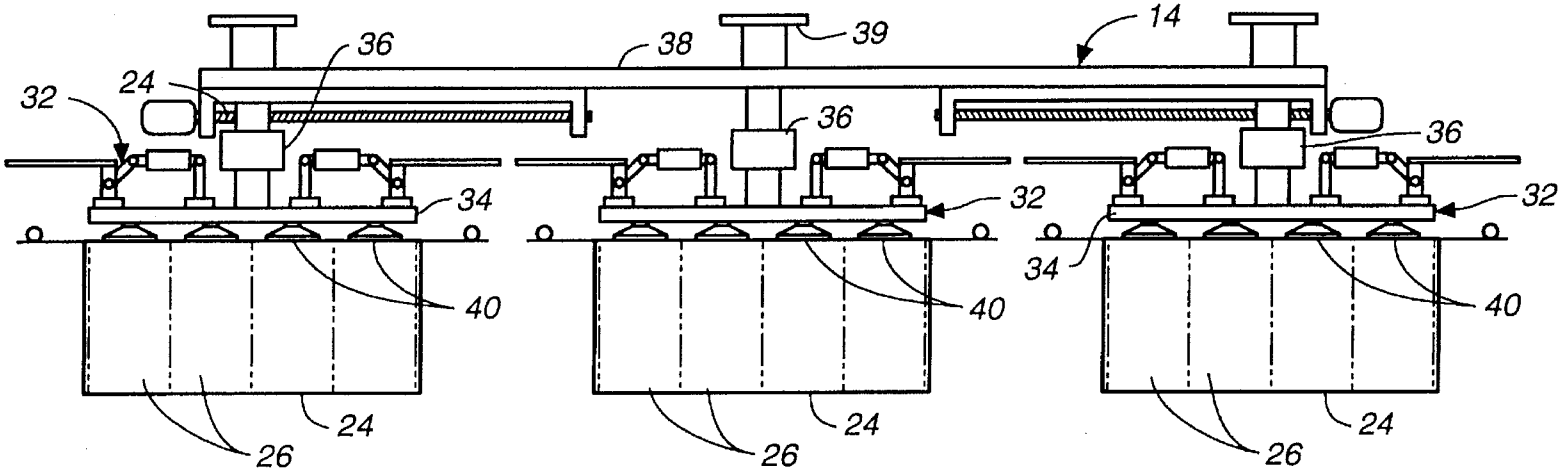
FIG. 9 is a diagrammatic elevation view of the three end effector units in the positions assumed thereby in FIG. 8.

The end effector units 32 are spaced and arrayed as shown in FIG. 8 when initially positioned over the three containers 24 deployed at the work station on conveyor 30. That is, the two end-most end effector units are at the ends of slide arm 38 and the primary axes of the end effector units are disposed along the primary axis of the slide arm. The robotic arm lowers the end effector units and a vacuum is applied to vacuum cups 40 to attach wrapped rolls engaged thereby to the end effector units. This is shown in FIG. 9.

Figure 10:
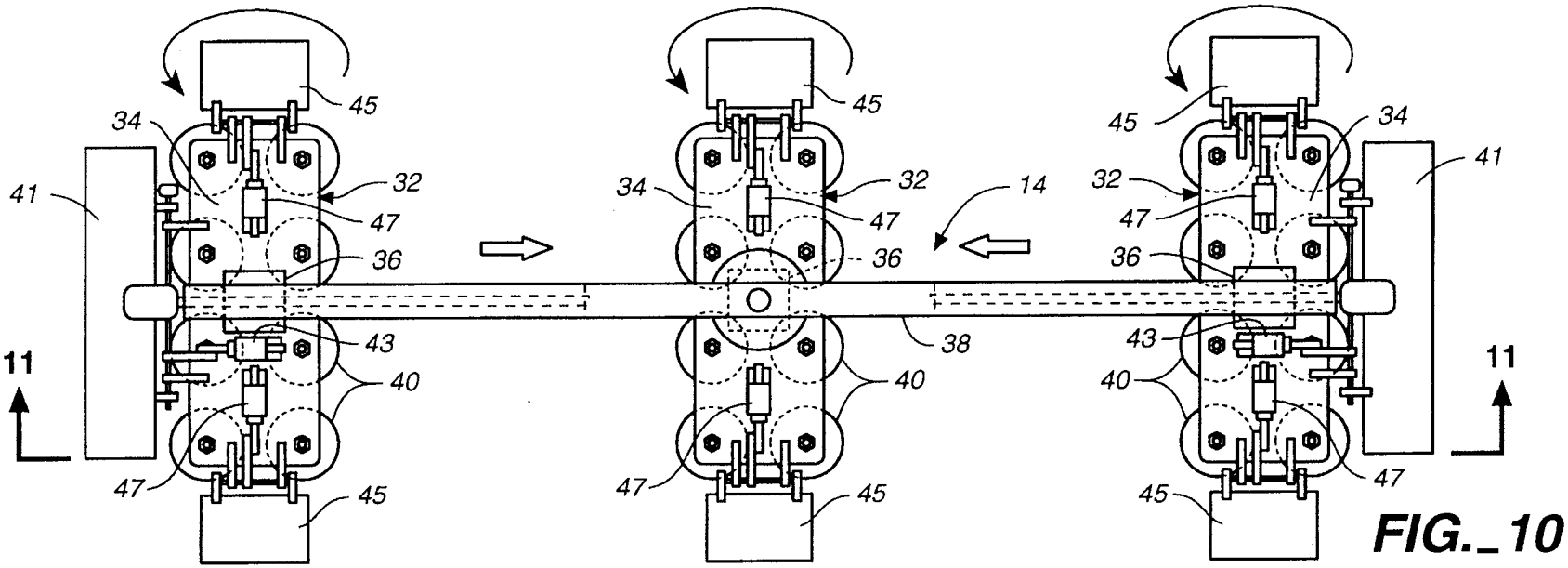
FIG. 10 is a diagrammatic top view of the three end effector units of FIG. 8 in relative positions assumed thereby at another stage of operation.
Figure 11:
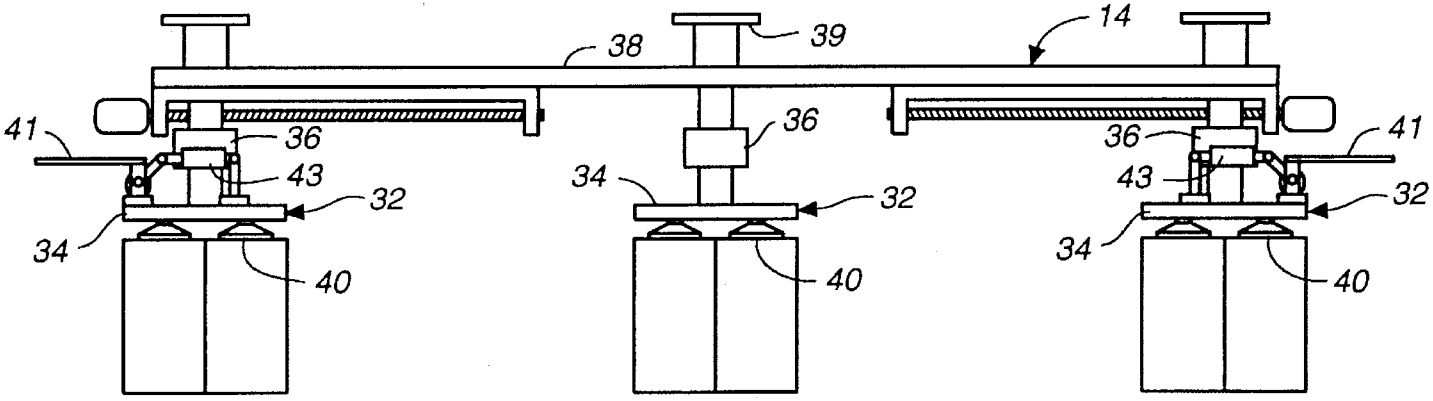
FIG. 11 is a diagrammatic elevation view of the three end effector units in the positions assumed thereby in FIG. 10.

The robotic arm then raises the end effector 14 to withdraw rolls 26 from the containers 24. The rotary actuators 36 are energized and cause the end effector units and rolls depending therefrom to rotate as shown in FIG. 2A and also as shown in FIGS. 10 and 11.

Figure 3:
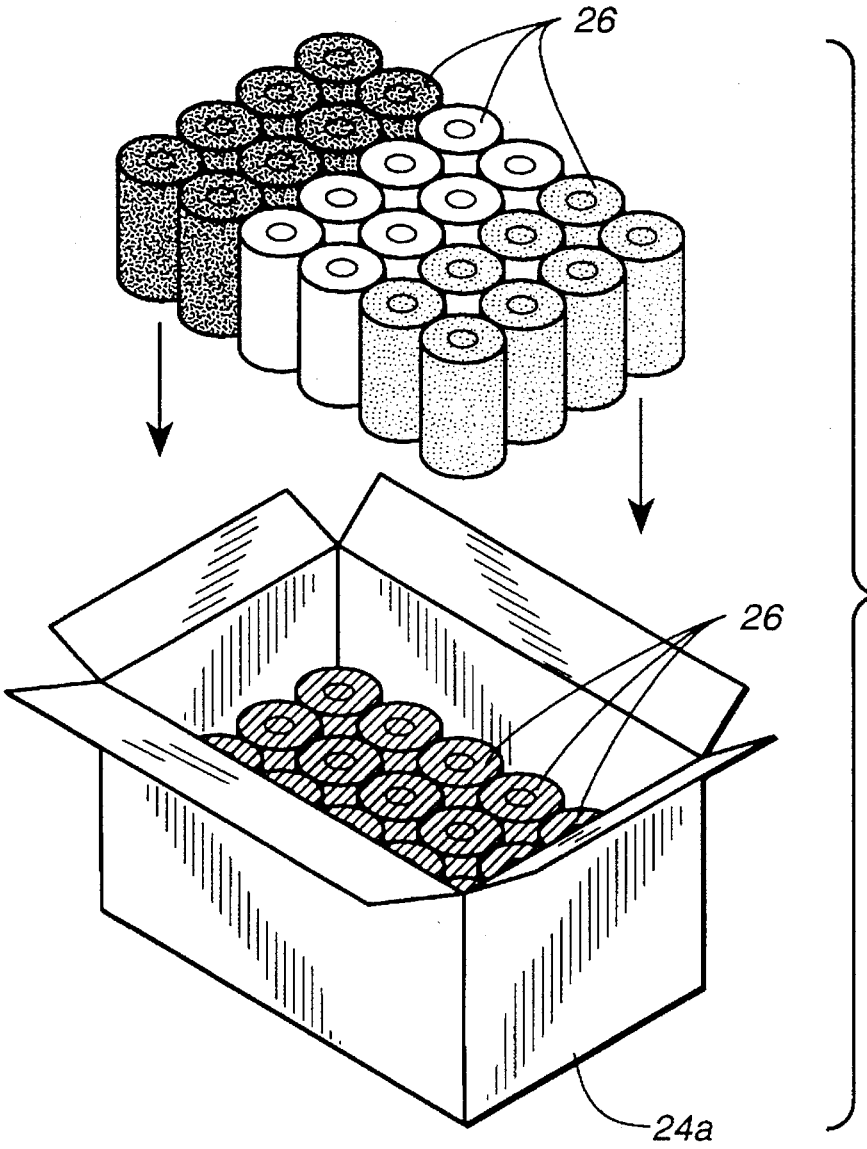
FIG. 3 is a diagrammatic presentation showing a layer of roll products of different colors being positioned in a container accommodating a single color layer of roll products.
Figure 12:
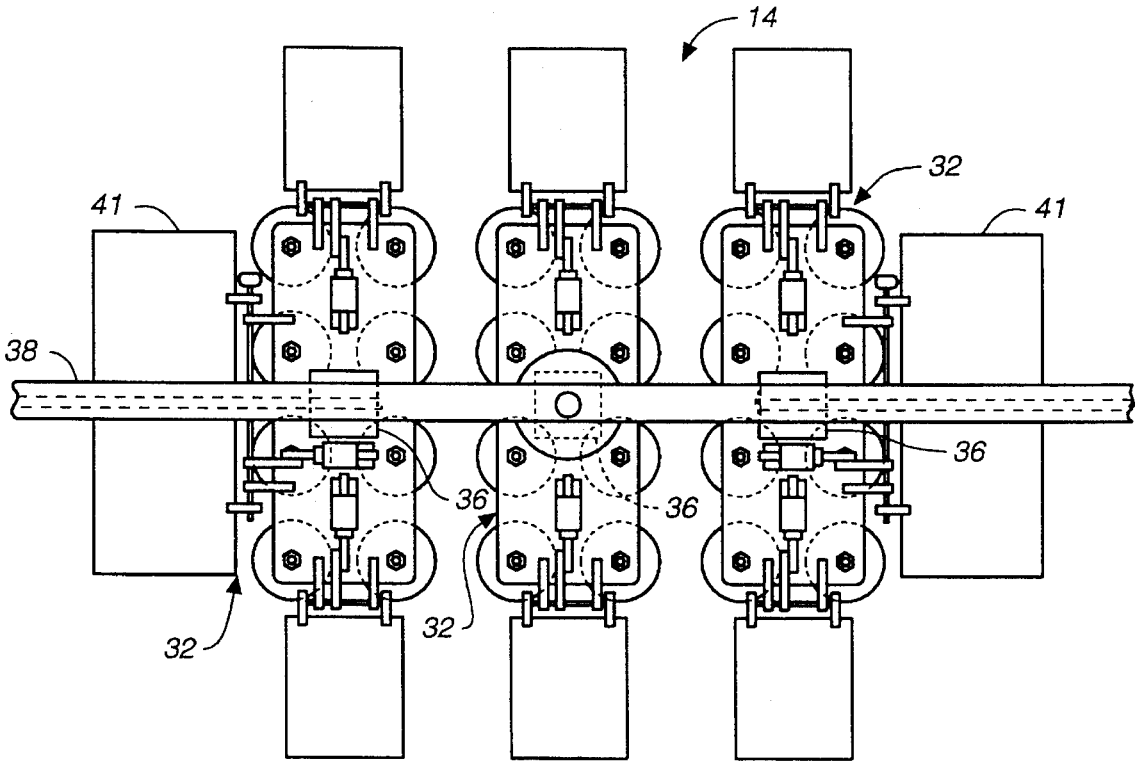
FIG. 12 is a diagrammatic elevation view of the three end effector units in relative positions assumed thereby in another stage of operation with flaps or clamping elements thereof in open position.
Figure 13:
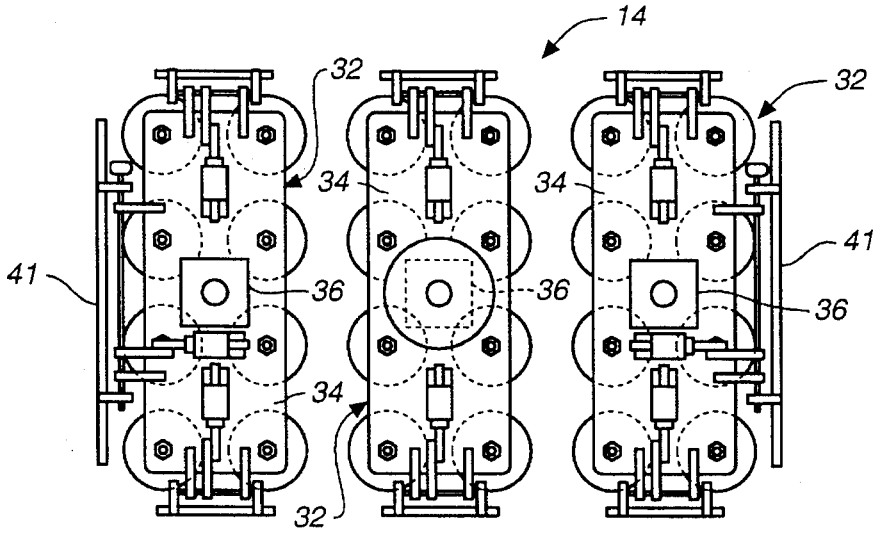
FIG. 13 is a view similar to FIG. 12 with the flaps or clamping elements closed.

The next stage of the operation is for the end effector units 32 to slide toward one another on the slide arm or bar 38 to bring together and consolidate the rows of rolls supported thereby. This consolidation, which may be accomplished by any suitable commercially available mechanism on end effector 14, such as electric motors associated with the end-most units to drive them along a track defined by slide arm 38 (not shown), creates six engaging rows of four rolls each which are configured as and correspond to a complete layer of roll products accommodated by a container 24. FIG. 10 depicts open arrows which show the direction of movement of the end-most end effector units and FIGS. 12 and 13 show the three end effector units just prior to completion of their movement toward each other. It will be appreciated that at the end of such movement, the rolls are consolidated and closely adjacent to each other as shown in FIG. 3 so that they can enter the box or container.

End effector 14 incorporates mechanism for ensuring such consolidation and also for assisting the vacuum cups in supporting the rolls. The end-most units 32 have elongated flaps or plates 41 which can move from the horizontal positions shown in FIG. 8, for example, to the vertical positions shown in FIG. 13. Hydraulic or electric cylinders 43 connected to flaps 41 control such movement.

Each unit 32 has two end flaps or plates 45 which also move between horizontal and vertical positions, such movement being controlled by cylinders 47.

All flaps or plates 41, 45 are open or horizontal until the units are moved together to consolidate the roll products held thereby. Then the cylinders 43, 47 are actuated to move the flaps to the vertical or closed positions (FIG. 13) to clamp the rolls together and facilitate placement in a container or box. In practice, the flaps themselves never actually enter the container so that they are free to be moved once again to horizontal when the lower ends of the rolls are in the container. The vacuum cups have the vacuum removed therefrom after the flaps have returned to a horizontal or open disposition to allow the rolls to complete their movement into a container or case under the influence of gravity.

Already positioned at the mixing station between the robot 10 and the conveyor 30 is a second set of containers 24*a*. Each of the containers 24*a* is precisely the same size as containers 24 and containers 24*a* at the mixing station hold therein one layer of packaged rolls 26 as shown, for example, in FIGS. 2C and 3. Robot 10 places the rolls held by end effector 14 over the layer of rolls already in a container 24*a* and places them on top of the existing layer. The lowermost layer of roll products in the disclosed embodiment of this invention is wholly comprised of rolls of the same color, in the present instance a fourth color differing from all three colors in the top tier or layer. Thus, the container 24*a*, when completely filled, has a mix of four colors of rolls therein. The containers 24*a* are supported by a conveyor and are discharged therefrom after being completed filled with rolls.

The work layout disclosed in FIG. 1 includes a robotic work station spaced from the mixing station at which is located a second robot 50 having a robotic arm 52 and an end effector 54.

The robotic work station has containers 24A delivered thereto by a conveyor 60 from a suitable source. When presented to the robotic work station serviced by robot 50, the, containers 24A are completely filled with roll products of the fourth color referenced above.

The primary purpose of the robotic work station is to remove the top tiers of these roll products and deliver the removed top tiers to empty containers which are delivered by conveyor 30 to the conveyor at the robotic work station. These containers are those which have been emptied at the mixing station. In the disclosed embodiment of the invention, end effector 54 is sized to remove a complete tier, the upper tier, from the full containers delivered to the robotic work station by conveyor 60.

FIGS. 4 through 7 illustrate details of a suitable end effector 54 which may be utilized for this purpose. End effector 54 has four relatively movable blades 62, 64, 66 and 68 which are operated by pneumatic cylinders 70 on the end effector frame. A rotary actuator 72 connects the end effector to the robotic arm 52 (FIG. 1). The bottom ends of the blades are preferably chamfered to facilitate movement of the end effector relative to the containers and rows of roll products therein. Vacuum cups 90 project downwardly between the blades and are selectively communicable with a vacuum source (not shown).

Figure 6:
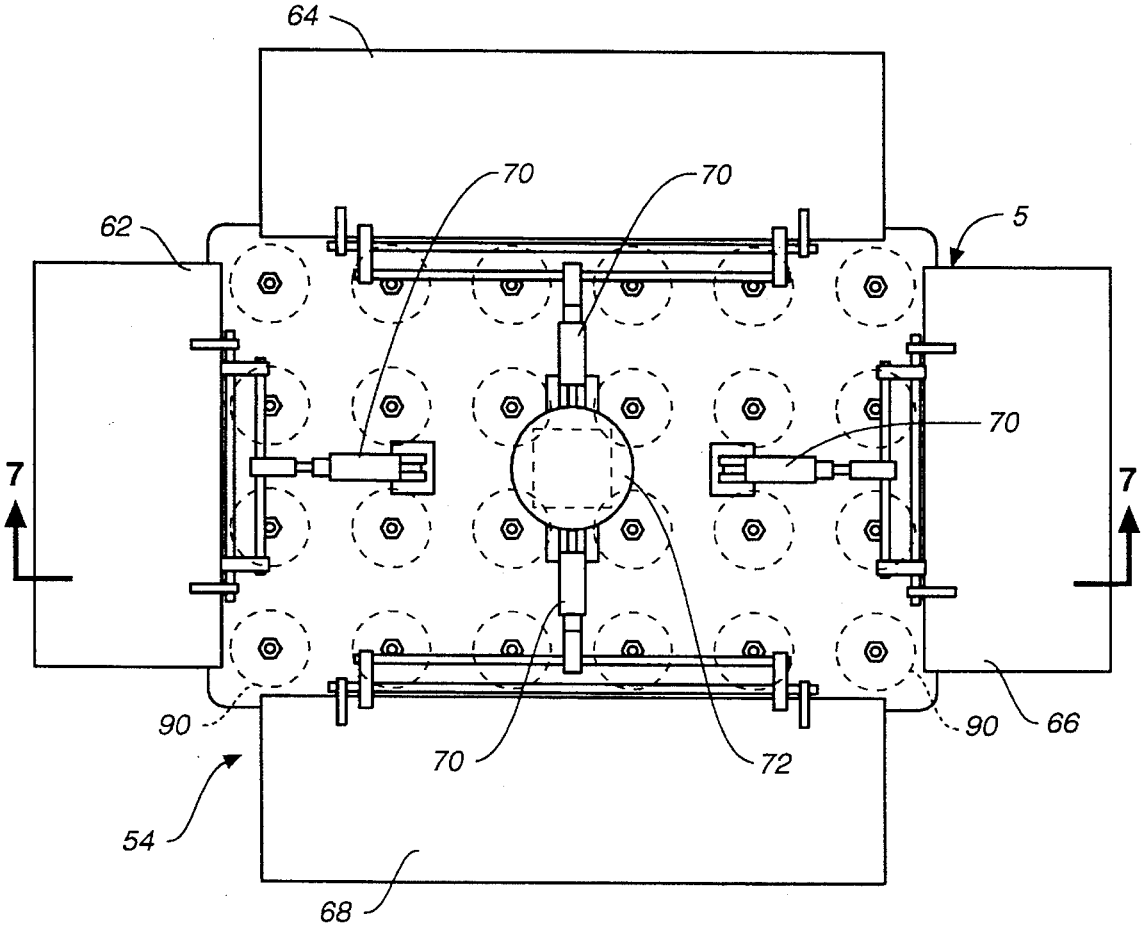
FIG. 6 is a view similar to FIG. 4 but showing the side and end plates in non-clamping position.
Figure 7:
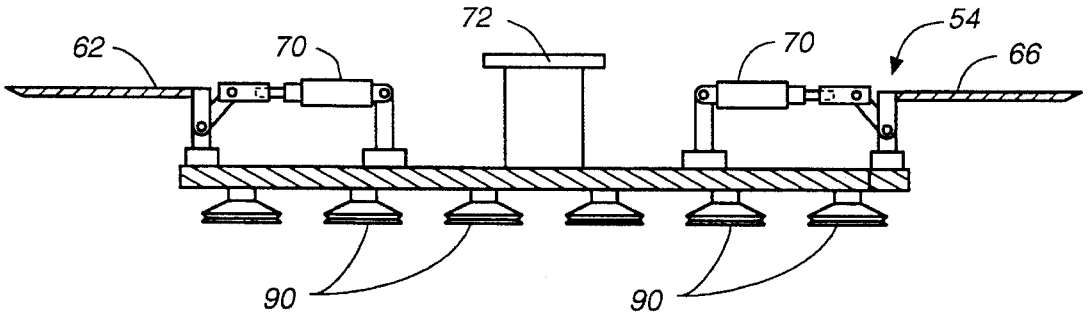
FIG. 7 is a cross-sectional view taken along the line 7—7 in FIG. 6 with the side and end plates in non-clamping position.

In operation, the end effector 54 is placed over the container to be partially emptied and lowered into position with the blades rotated upwardly and disposed generally horizontally as shown in FIGS. 6 and 7 and a vacuum applied to cups 90. The robot 50 raises the end effector 54 with the top layer of roll packages attached thereto by the vacuum cups.

Figure 4:
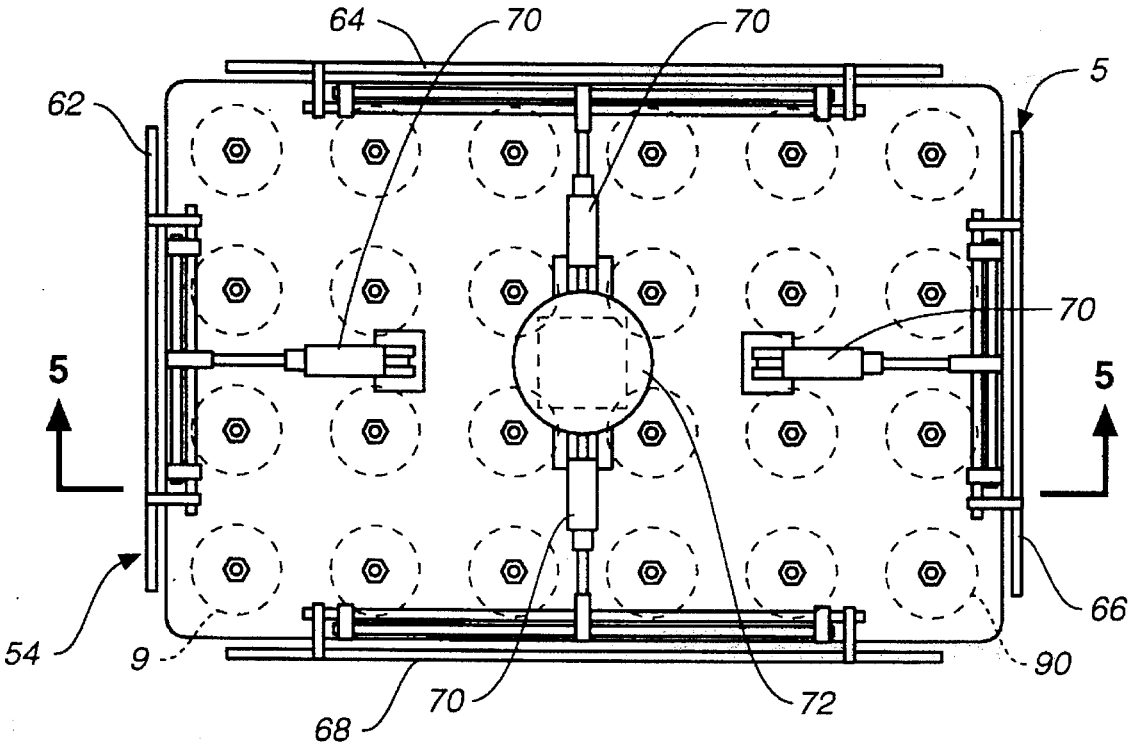
FIG. 4 is a diagrammatic top plan view of an end effector used to remove roll products from a container or to insert products in a container and illustrating side and end plates in clamping position.
Figure 5:
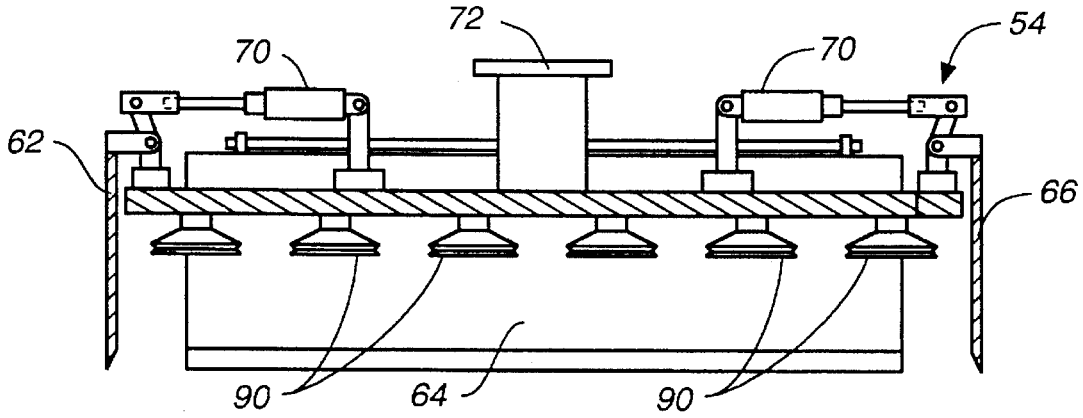
FIG. 5 is a cross sectional view of the end effector taken along the line 5—5 in FIG. 4.

The pneumatic rotary actuator 72 then rotates the blades to the vertical orientation shown in FIGS. 4 and 5 to clamp the rolls. The robot 50 now transfers the tier of roll products held thereby to an adjacent empty container delivered by conveyor 30. It will be appreciated that the containers delivered to the mixing station thus comprise both containers which were previously placed at the mixing station and emptied at the mixing station as well as those delivered as completely filled containers to the robotic work station by conveyor 60.

I claim:

1. A method of mixing articles having differing physical characteristics in a plurality of containers, said method comprising the steps of:

conveying a first set of containers to a mixing station, at least one container of said first set of containers containing a plurality of articles having physical characteristics differing from physical characteristics of a plurality of articles in other containers of said first set of containers, said plurality of articles in at least one of said plurality of containers of said first set of containers being disposed in a plurality of rows;

transporting a second set of containers to said mixing station, each of said containers of said second set of containers defining a space for accommodating a layer of articles;

at said mixing station, substantially simultaneously removing at least one row of articles from each of the containers of said first set of containers;

at said mixing station and after said removal step, moving the rows of articles removed from the containers of said first set of containers relative to one another to consolidate said rows;

substantially simultaneously inserting the removed and consolidated rows of articles into at least one container of said second set of containers at said mixing station to at least partially form a layer of articles therein comprised of a mix of articles from all the containers of said first set of containers;

introducing empty containers from said first set of containers into said second set of containers after all of the articles have been removed from containers at said mixing station, at least some of the containers of said second set of containers comprising supplemental containers transported to said mixing station from a source of supplemental containers completely filled with articles;

partially emptying the completely filled supplemental containers at a predetermined location spaced from said mixing station by removing articles therefrom; and transporting the partially emptied supplemental containers from said predetermined location to said mixing station.

2. The method according to claim 1 wherein the articles in each container of said first set of containers at said mixing station are of a single color, the color of articles in each container of said first set of containers differing from the color of the articles in the other containers of said first set of containers.

3. The method according to claim 1 wherein said containers of said second set of containers transported to said mixing station each have at least one layer of articles therein when transported to said mixing station, said step of substantially simultaneously inserting the removed and consolidated rows of articles comprising placing the removed and consolidated rows of articles on a layer of articles in at least one container of said second set of containers at said mixing station.

4. The method according to claim 1 including the steps of transporting containers of said first set of containers after all of the articles have been removed therefrom from said mixing station to said predetermined location and transferring the articles removed from the supplemental containers to containers of said first set of containers at said predetermined location.

5. The method according to claim 1 wherein said step of removing at least one row of articles from the containers of said first set of containers includes clamping the articles to be removed by a robotic end effector and lifting the clamped articles from the containers of said first set of containers with said robotic end effector.

6. The method according to claim 5 wherein movement and consolidation of the rows of articles removed from the containers of said first set of containers and said insertion step are carried out by said robotic end effector.

7. The method according to claim 4 wherein the steps of partially emptying the completely filled supplemental containers and transferring the articles removed from the supplemental containers to containers of the first set of containers at said predetermined location are carried out by a robotic end effector.

8. The method according to claim 1 wherein the conveying step comprises transporting the containers of said first set of containers on separate conveyors, said conveyors positioning the containers of said first set of containers side by side at said mixing station.

9. Apparatus for mixing articles having differing physical characteristics in a plurality of containers, said apparatus comprising, in combination:

a mixing station including a first robot having an end effector;

first conveyor means for conveying a first set of containers to said mixing station, at least one container of said first set of containers containing a plurality of articles having physical characteristics differing from physical characteristics of a plurality of articles in at least one of the other containers of said first set of containers and disposed in a plurality of rows;

transport means for transporting a second set of containers to said mixing station, said containers of said second set of containers each defining a space for accommodating a layer of articles, the end effector of said first robot operable to remove at least one row of articles from each of the containers of said first set of containers, move the rows of articles removed from the containers of said first set of containers relative to one another to consolidate said rows and insert the removed and consolidated rows of articles into at least one container of the second set of containers transported to said mixing station by said transport means to at least partially form a layer of articles therein comprised of a mix of articles from all the containers of said first set of containers;

means for supplying supplemental containers and for introducing said supplemental containers into said second set of containers; and a robotic work station spaced from said mixing station, a second robot having an end effector at said robotic work station, and supplemental container delivery means for delivery of supplemental containers filled with articles to said robotic work station.

10. The apparatus according to claim 9 wherein the articles of each container of said first set of containers at said mixing station are of a single color, the color of articles in each container of said first set of containers differing from the color of articles in the other containers of said first set of containers.

11. The apparatus according to claim 9 additionally comprising means for introducing containers of the first set of containers into said second set of containers after the end effector of said first robot has removed at least one row of articles from each of the containers of said first set of containers.

12. The apparatus according to claim 9 additionally comprising means for conveying containers of said first set of containers to said robotic work station, said second robot operable to remove at least some of the articles from supplemental containers at said robotic work station and transfer the removed articles to containers of said first set of containers conveyed to said robotic work station.

* * * * *